US005445535A

United States Patent [19]

Phillips, Jr. et al.

[11] Patent Number: 5,445,535

[45] Date of Patent: Aug. 29, 1995

[54] INSULATION DISPLACEMENT TERMINAL

[75] Inventors: William T. Phillips, Jr., Boardman; Michael J. Bezusko; George E. Finn, both of Warren, all of Ohio

[73] Assignee: General Motors Corporation, Detroit, Mich.

[21] Appl. No.: 235,957

[22] Filed: May 2, 1994

[51] Int. Cl.[6] ..... H01R 9/05

[52] U.S. Cl. ..... 439/394; 439/578; 439/877

[58] Field of Search ..... 439/877–881, 439/395–407, 420, 421, 422, 426, 578, 394

[56] References Cited

U.S. PATENT DOCUMENTS

| | | | |
|---|---|---|---|
| 3,058,088 | 10/1962 | Miller | 439/421 |
| 3,355,698 | 11/1967 | Keller | 339/97 |
| 3,650,706 | 3/1972 | Parsons | 29/193.5 |
| 3,831,132 | 8/1974 | Bowden, Jr. et al. | 339/95 R |
| 3,857,995 | 12/1974 | Wyrick | 174/84 C |
| 3,964,815 | 6/1976 | McDonough | 339/97 C |
| 3,990,143 | 11/1976 | Dittmann et al. | 29/628 |
| 4,304,454 | 12/1981 | Yokota et al. | 339/97 C |
| 4,560,225 | 12/1985 | Margaroli et al. | 439/877 |
| 4,565,418 | 1/1986 | Graeser, Jr. et al. | 339/97 C |
| 4,701,137 | 10/1987 | De Ross | 439/394 |
| 4,738,009 | 4/1988 | Down et al. | 439/425 |
| 4,812,138 | 3/1989 | Kondo et al. | 439/865 |
| 4,815,200 | 3/1989 | Ito | 29/857 |
| 4,840,578 | 6/1989 | Sato | 439/395 |
| 4,884,984 | 12/1989 | Matsumoto | 439/877 |
| 5,025,554 | 6/1991 | Dohi | 29/860 |
| 5,188,536 | 2/1993 | Ganthier et al. | 439/406 |

*Primary Examiner*—David L. Pirlot
*Attorney, Agent, or Firm*—Jeffrey A. Sedlar

[57] ABSTRACT

A method of terminating an electrical cable wherein the insulation of the cable is slit axially inward toward, but not completely to, the conductor and a terminal in crimped into the slit displacing the remaining insulation and establishing electrical contact between the terminal and conductor.

6 Claims, 4 Drawing Sheets

INSULATION DISPLACEMENT TERMINAL

BACKGROUND OF THE INVENTION

This invention relates to the termination of electrical cables and a method of making a terminal and cable assembly.

Electrical cables are typically comprised of a center electrical conductor that is surrounded by insulation. Conventional crimp-on type electrical terminals have typically been used to provide a connection to the cable. Terminals of this type generally have a first crimp barrel portion which contacts the center electrical conductor and a second crimp barrel portion that attaches around the insulation of a cable. With this type of terminal, the end of the cable must be stripped of its insulation to bare a segment of the electrical conductor before the terminal can be attached. In addition to the insulating material, electrical cables may be comprised of an additional jacketing material which will be stripped and discarded along with the insulation in the conventional stripping operation, thereby adding additional expense.

Because of the processing and material waste costs associated with stripping the ends of a cable in preparation for termination, terminals have been developed that include a crimp barrel portion that attaches around the insulation of a cable and an insulation piercing portion to provide contact with the electrical conductor without stripping the end of the cable. With this type of terminal, material does not have to be stripped from the cable and discarded.

Insulation piercing terminals have found widespread use. However, their use in some applications including the termination of automotive ignition cables has been limited. The reason is that particularly in ignition cable applications, insulation piercing terminals have proven to have inherent reliability problems. A conventional insulation piercing terminal uses sharp edges to cut through the jacket and insulation layers of an electrical cable. The sharp edges make electrical contact with the conductive core of the cable. When the cable assembly is put into use, the sharp edges can lead to high E-field stresses causing burn damage to the conductor. In addition, sharp terminal edges may cut the conductive core which is often comprised of soft non-metallic material. Core cutting or disfigurement can cause arc discharges to occur, which can also lead to conductor burn damage. In addition, inadvertent cutting of the conductive core lowers terminal pull-off forces.

Due to the shortcomings associated with conventional insulation piercing terminals, ignition cables are generally terminated according to a conventional stripping and crimp-barrel type terminal assembly. Therefore, typical termination of an ignition cable involves the process of removing and discarding insulation from the cable.

Once the insulation is removed from an ignition cable the conductive core is typically bent back around the end of the remaining insulation and against the jacket before the terminal barrel is crimped thereover. This type of assembly which includes bending of the conductor is not readily susceptible to application of automated product quality assurance techniques such as vision systems. Therefore, an improvement in the termination of automotive ignition cables will result in better quality control, cost savings and accordingly, is needed. A termination method providing such benefits will additionally lend itself to application in other systems where insulation piercing terminals have proven inadequate or where an improved method of termination is preferred.

When wire wound conductive cores are used in ignition wires the stripping and bending technique has proven difficult. Stripping the insulation from the relatively small diameter conductor can lead to damaging or unraveling the core. This further complicates the termination of ignition cables using conventional techniques.

SUMMARY OF THE INVENTION

To address the shortcomings associated with the conventional methods of electrical cable termination, the present invention is presented. This invention includes a novel insulation displacement terminal that does not require stripping insulation from a cable prior to termination and does not include the sharp edges associated with insulation displacement type termination typically required to pierce through the insulation of a cable.

To eliminate the sharp edges, a slit is first prepared in the insulating material of a conductor near its end. The insulation displacement terminal is then crimped into the slit and a smooth surface of the terminal contacts the electrically conductive core without damaging or disfiguring the core. This type of assembly results in a more reliable method of cable termination. The contact that is established between the terminal and the conductive core of the cable can be more closely controlled and monitored.

By eliminating the sharp piercing edges from the terminal, high E-field stresses are avoided. Elimination of the strip and core bend process associated with previous methods of termination results in a material savings and reduces the opportunity for insufficient electrical contact formation.

DETAILED DESCRIPTION OF THE PRESENTLY PREFERRED EMBODIMENTS

The present invention is described and illustrated in detail within the context of an automobile ignition system, however it is recognized that this method of termination is readily applicable in other contexts.

Figure 1A:
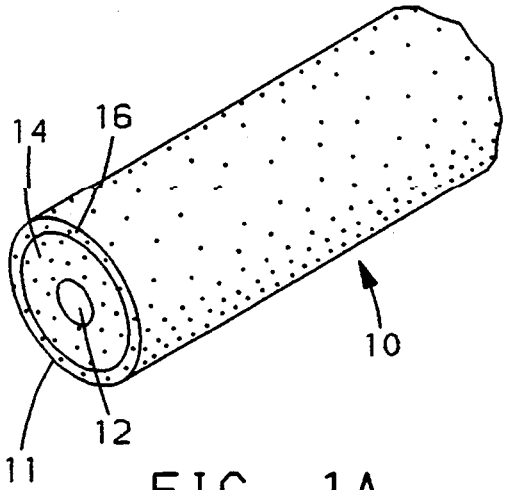
FIG. 1A is a perspective view of a length of cable.

FIG. 1A shows the prepared end 11 of an ignition cable 10 which has been blunt cut in a conventional manner. The cable 10 is comprised of an electrically conductive core 12 having selected resistivity properties to properly perform in an automobile's ignition system (not illustrated). The core 12 may be comprised of a metallic wire wound construction which is non-compressible. The core 12 may also be comprised of strands, or a strand, of compressible non-metallic material such as high temperature nylons, polyamides, silicones and other high tensile strength materials which are coated, impregnated or otherwise suitably treated to make them electrically conductive. Therefore, termination methods according to this invention are designed to be operable with both compressible and noncompressible cores, however, the embodiments of FIGS. 1A–1D, 2A–2D and 3A–3B, are more suited to use with non-compressible, wire wound core cables.

Surrounding the conductive core 12, of cable 10, is a layer of EPDM or SBR synthetic rubber insulation 14 or a like material. Surrounding the insulating layer 14 is a jacket layer 16 of Hypalon, Cosil, silicone or similar jacketing materials. The insulating layer 14 and jacketing layer 16 materials are relatively expensive and therefore preferably not discarded.

The cable 10 is cut to the preferred length for its intended use through a blunt cutting process. This preparation leaves a prepared end of this cable segment and a leading end of the next segment ready for the termination process.

Figure 1B:
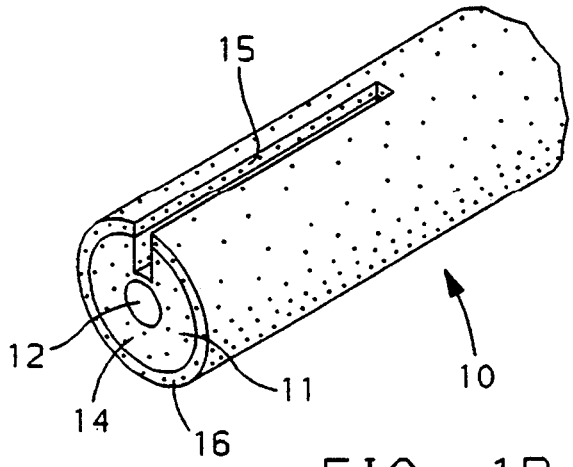
FIG. 1B is a perspective view of a length of cable with a slit end.

FIG. 1B illustrates a longitudinal axial slit 15 that has been prepared in the insulating layer 14 and jacketing layer 16 material of the cable 10. Notable, is the fact that the slit 15 does not extend axially completely to the conductive core 12 of the cable 10. This insures that the conductive core 12 is not marred or deformed in any manner during the slitting process. Due to preparation of the slit 15 in the insulating layer 14 and jacketing layer 16, the terminal does not require a sharp edge to displace the insulation 14 and jacketing 16 to contact the conductive core 12.

Figure 1C:
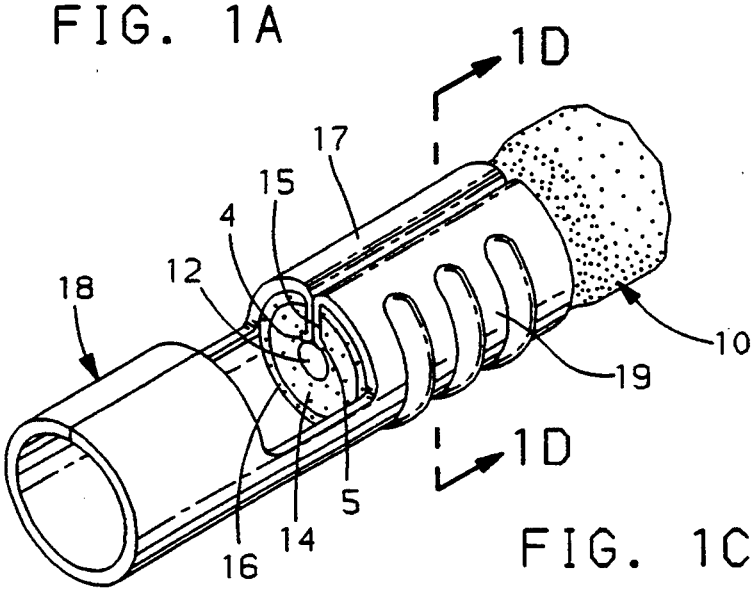
FIG. 1C is a perspective view of a terminal and cable assembly according to an embodiment of the present invention.

FIG. 1C illustrates the application of a terminal 18 to the prepared cable 10. The terminal 18 may be of a conventional ignition type or a modified version, but in either case has blunt edges 4 and 5 on the tabs, referred to as crimp wings 17 and 19. Edges 4 and 5 are slightly bent to present smooth surfaces adjacent the edges to contact the core thereby preventing arcing when the cable is put into use. The terminal 18 is crimped into the longitudinal axial slit 15 that has been prepared in the cable 10. The crimping operation causes the blunt edges 4 and 5 of the crimp wings 17 and 19 to displace the remaining insulation disposed around conductive core 12. Smooth surfaces on crimp wings 17 and 19, adjacent to blunt edges 4 and 5, make electrical contact with the conductive core 12 through the slit 15 area. In this assembly process, both the electrical and the mechanical crimps are performed simultaneously.

Figure 1D:
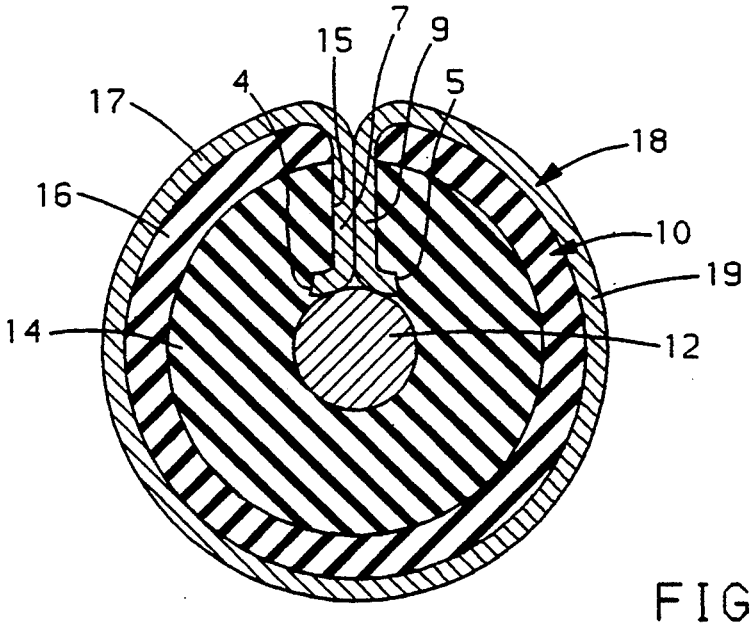
FIG. 1D is a sectional view taken generally along the plane indicated by lines 1D—1D in FIG. 1C.

FIG. 1D illustrates in cross section the assembly illustrated in FIG. 1C. The crimp wings 17 and 19 of the crimped terminal 18 extend axially through the jacketing layer 16 and insulating layer 14 of the cable 10 and the blunt edges 4 and 5 are slightly bent, providing smooth surfaces for contacting the conductive core 12. Alternatively, the blunt edges 4 and 5 can contact the core directly. The electrical contact that is established between the terminal 18 and the conductive core 12 avoids the creation of high E-field stresses that were likely to occur with previous insulation piercing terminal construction.

Figure 2A:
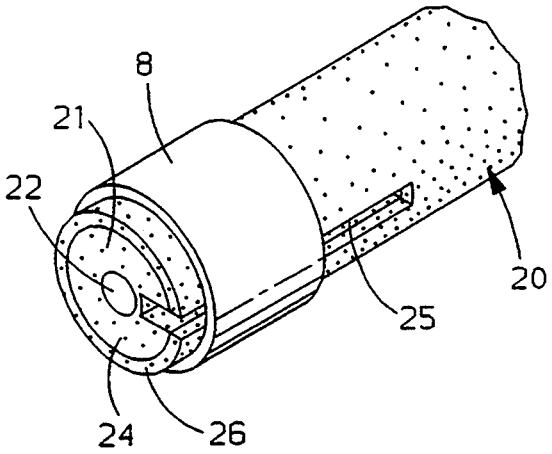
FIG. 2A is a perspective view of a length of cable with a slit end and an annular band disposed thereon.

FIGS. 2A–2D illustrate an alternative embodiment of the present invention. FIG. 2A illustrates the end of an ignition cable 20 that has been prepared by being blunt cut at 21 and slit at 25. The prepared slit 25 extends longitudinally and axially through the jacket layer 26 but only substantially through the insulating layer 24 stopping short of the conductive core 22. Also shown is an annular metal band 8 that has been placed over the prepared end of the cable 20 and is disposed around the slit 25.

Figure 2B:
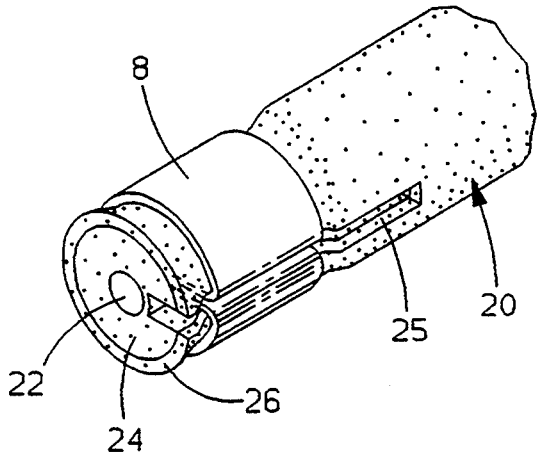
FIG. 2B is a perspective view of the length of cable in FIG. 2A with the annular band crimped into the slit.

In FIG. 2B the annular metal band 8 has been F-crimped into the prepared slit 25. As the annular metal band 8 is being crimped, it displaces the remaining insulation that exists at the bottom of slit 25 about the conductive core 22, to establish electrical contact between the band 8 and the core 22.

Figure 2C:
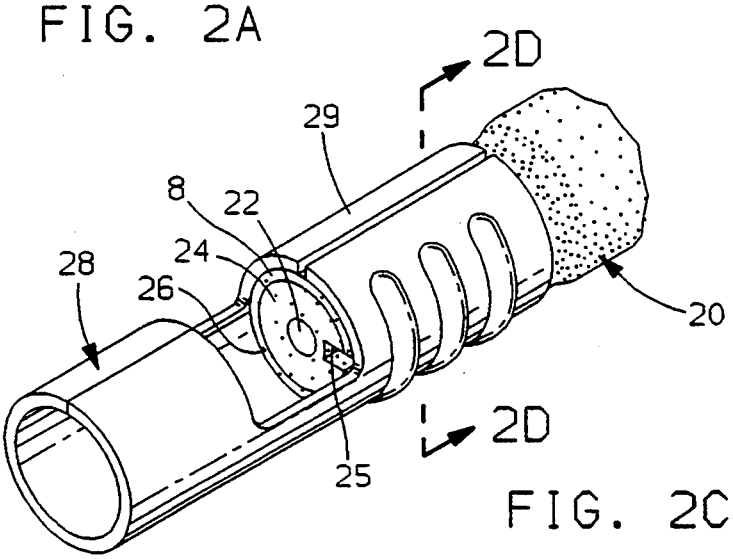
FIG. 2C is a perspective view of the length of cable in FIG. 2B with a terminal assembled thereon according to an embodiment of the present invention.

In FIG. 2C a terminal 28 is disposed over the crimped annular metal band 8. Crimp barrel 29 is crimped onto the end of the cable 20 to mechanically attach the terminal 28 to the cable 20 and to establish electrical continuity between the core 22, annular metal band 8 and terminal 28.

Figure 2D:
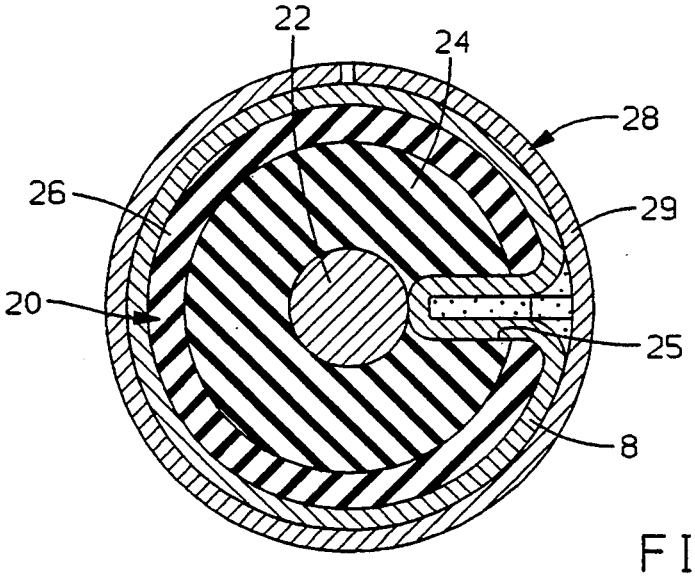
FIG. 2D is a sectional view taken generally along the plane indicated by lines 2D—2D in FIG. 2C.

FIG. 2D illustrates in cross section the assembly of FIG. 2C. The annular metal band 8 extends through the jacketing layer 26 and insulating layer 24 providing a smooth surface establishing electrical contact with the conductive core 22. The crimp barrel 29 of terminal 28 is crimped around the outside diameter of the annular metal band 8 and establishes electrical contact therebetween.

Figure 3A:
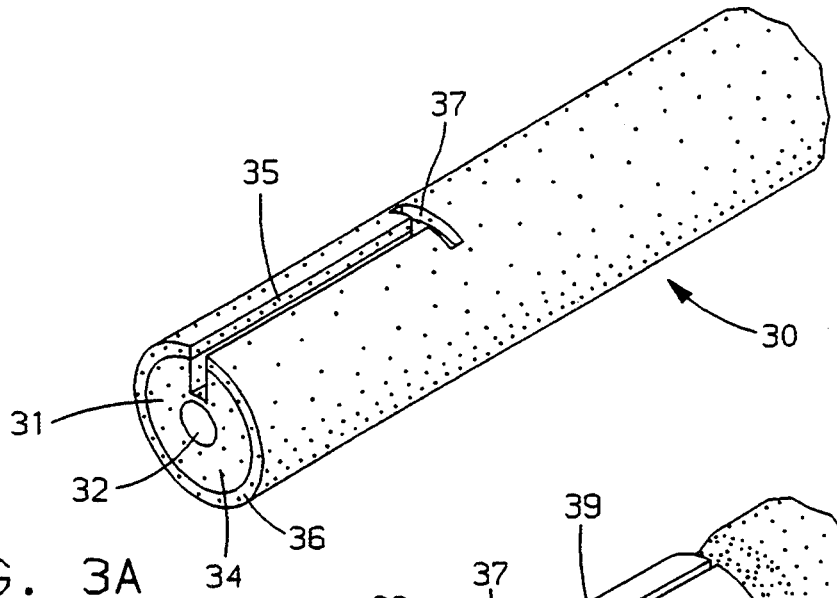
FIG. 3A is a perspective view of a length of cable with a slit end.
Figure 3B:
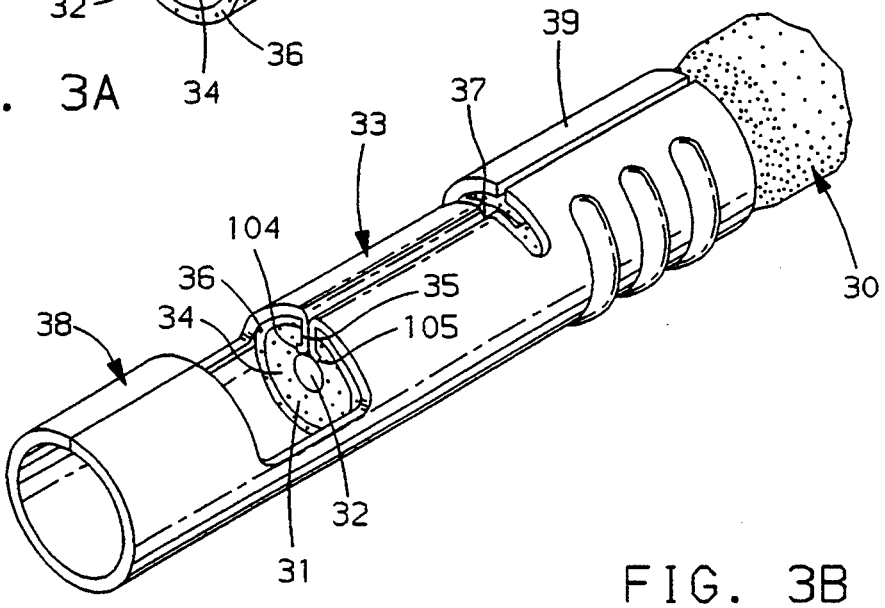
FIG. 3B is a cable and terminal assembly according to an embodiment of the present invention.

FIGS. 3A and 3B illustrate an alternative embodiment of the present invention. In FIG. 3A the end of a cable 30 has been prepared with a longitudinal slit 35 extending axially through the jacketing layer 36 and substantially through the insulating layer 34 stopping short of the conductive core 32. A lateral slit 37 is similarly formed perpendicular to and contiguous with, the longitudinal slit 35 at its end, opposite the end 31 of the cable 30.

FIG. 3B illustrates the prepared cable 30 from FIG. 3A with a terminal 38 added. The terminal 38 has a two-part crimp barrel area. The first portion, crimp barrel 33, of the crimp barrel area has been crimped into the longitudinal slit 35. The ends of the crimp wings 104 and 105 are slightly bent to provide a smooth surface establishing an electrical contact with the conductive core 32. The second portion, crimp barrel 39, of the crimp barrel area is secured about the insulating jacket layer 36 adjacent to the lateral slit 37. The first portion 33 of the crimp barrel area is formed such that during crimping the tabs are directed into the longitudinal slit 35, displacing the remaining cable insulation that is disposed about the conductive core 32. Crimping establishes electrical contact between smooth surfaces adjacent to or at the edges 104 and 105 of the crimp barrel wings and the conductive core 32.

The lateral slit 37 that has been prepared substantially through the insulating layer 34 and through the jacketing layer 36 inhibits the propagation of the longitudinal slit 35 that could otherwise be induced along the cable 30 by the crimping process. The second portion of the crimp barrel area, crimp barrel 39, provides the mechanical crimping function and utilizes a round crimped configuration to optimize mechanical retention characteristics of the terminal 38 on the cable 30.

Figure 4A:
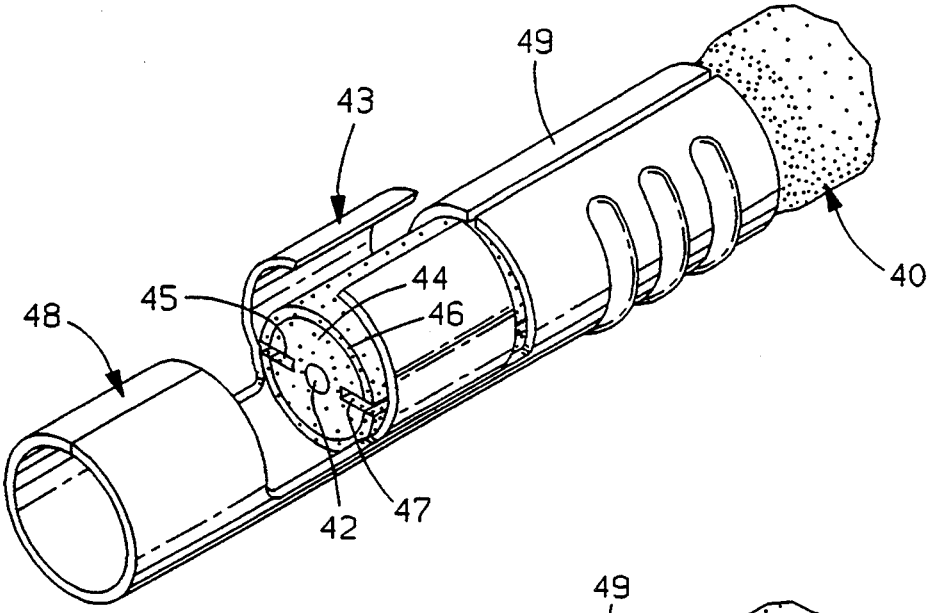
FIG. 4A is a perspective view of a length of cable with a slit end and having a terminal placed thereon.
Figure 4B:
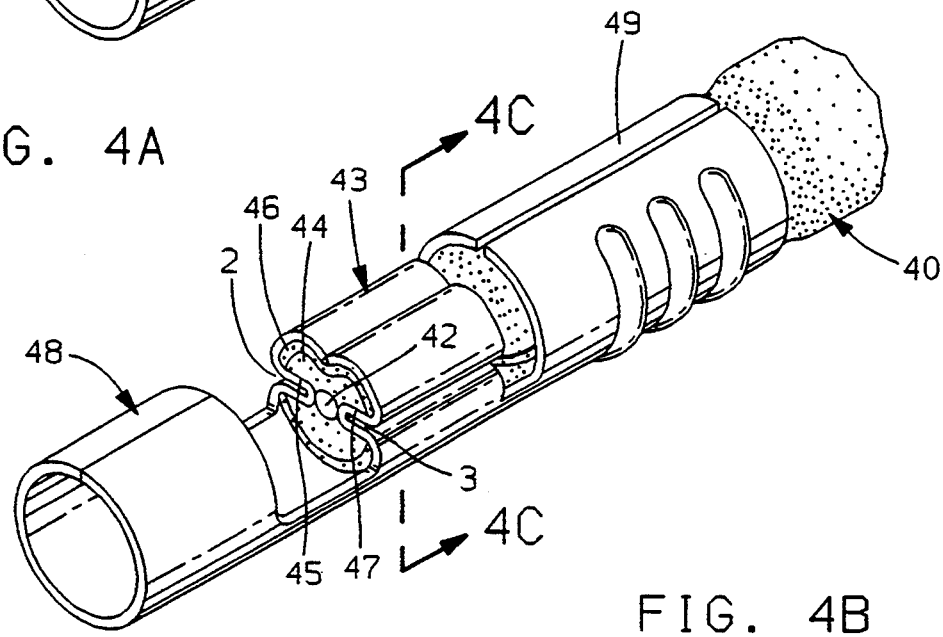
FIG. 4B is a cable and terminal assembly according to an embodiment of the present invention.
Figure 4C:
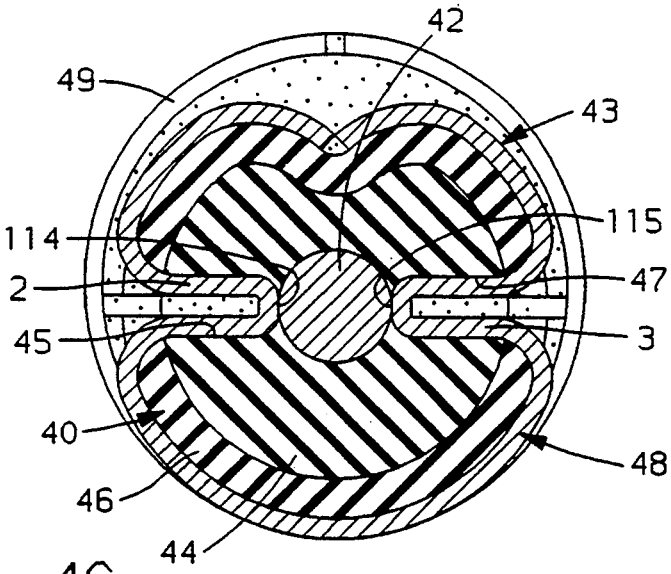
FIG. 4C is a sectional view taken generally along the plane indicated by lines 4C—4C in FIG. 4B.

FIGS. 4A–4C illustrate another embodiment of the present invention. This embodiment includes a split crimp barrel area with the first portion of the crimp barrel area, crimp barrel 43, providing electrical contact with the conductive core. Crimp barrel 43 is comprised of a gull-wing type construction for a dual F-crimped assembly. The end of the ignition cable 40 has been prepared with two longitudinal slits 45 and 47 through the jacketing layer 46 and substantially through the insulating layer 44 stopping short of the conductive core 42. The longitudinal slits 45 and 47 are disposed diametrically on opposite sides of the conductive core 42. A terminal 48 is positioned over the end of the prepared cable 40.

FIG. 4B illustrates the terminal 48 crimped onto the cable 40. The crimp wings on the crimp barrel 43 of the terminal 48 establish electrical contact with the core 42 and have two F-crimped parts 2 and 3 disposed through the insulating layer 44 and jacketing layer 46, establishing electrical contact with the conductive core 42. As the wing parts 2 and 3 are F-crimped onto the cable 40, they displace the remaining insulating material that is disposed about the conductive core 42 at the bottom of the longitudinal slits 45 and 47. The second portion of the crimp barrel area, crimp barrel 49, is mechanically crimped around the insulating and jacketing material.

FIG. 4C illustrates in cross section the assembly of FIG. 4B. The dual F-crimp construction assures accuracy of the electrical contact that is established between the crimp wings and the conductive core 42. Smooth surfaces 114 and 115 of the terminal 48 provide electrical contact with the conductive core 42, avoiding the problems associated with disfigurement of the core when piercing type contact is used.

Figure 5:
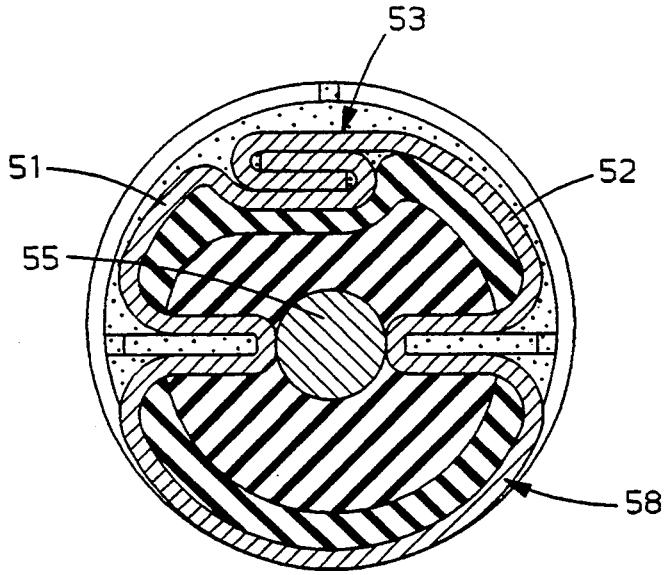
FIG. 5 is a cross sectional view of an embodiment of the present invention.

FIG. 5 shows in cross section an assembly similar to that of FIG. 4C. The additional component included in FIG. 5 is the C-shaped interlock 53 provided at the ends of the crimp wings 51 and 52. The advantage of providing C-interlock 53 is that compression set is minimized. Stated otherwise, providing the C-interlock 53 in the ends of the crimp wings 51 and 52 insures that if relaxation of the metal terminal 58 occurs from exposure to high temperatures or other factors, the electrical contact between the terminal 58 and the conductive core 55 is not degraded by movement of the terminal material.

As evident from FIGS. 1D, 2D, 4C and 5, this invention lends itself to automated quality assurance techniques. A conventional vision system can readily be applied to evaluate the acceptability of an assembly formed by the processes described herein.

The embodiments of the invention in which an exclusive property or privilege is claimed is defined as follows:

1. An insulation displacement terminal for use with a conductor having insulation and a prepared slit in the insulation comprising:

a crimp barrel portion having a pair of insulation displacement tabs with blunt leading edges crimped into the prepared slit and smooth surfaces contacting the conductor establishing electrical connection therewith without disfiguring the conductor.

2. An insulation displacement terminal connection including a conductor having insulation and a prepared slit in the insulation comprising:

a conductive band crimped into the prepared slit establishing electrical connection between a smooth surface of the crimped band and the conductor; and a terminal having a crimp barrel crimped over the conductive band.

3. A method of termination, including making an electrical contact between a longitudinal cable having an axial conductor radially surrounded by insulation material and a terminal having tabs and a two stage crimp area comprising the steps of:

a. forming a longitudinal slit in the insulation material radially inward to a depth less than that required to reach the conductor;

b. forming a lateral slit radially inward to a depth less than that required to reach the conductor;

c. positioning the terminal with the tabs near the longitudinal slit;

d. crimping the terminal wherein the tabs enter the slit piercing axially through the remaining insulation material to make electrical contact between the terminal and the conductor and the terminal is mechanically attached to the conductor.

4. A method of termination including making an electrical contact between a longitudinal cable having an axial conductor radially surrounded by insulation and a terminal having a crimp barrel and a conductive band comprising the steps of:

a. blunt cutting an end of the cable;

b. forming a longitudinal slit in the insulation radially inward to a depth less than that required to reach the conductor, near the end of the cable;

c. positioning the conductive band over the slit;

d. crimping the conductive band into the slit forcing the band through the remaining insulation between the slit and the conductor to make contact between the conductive band and the conductor;

e. positioning the terminal's crimp barrel over the conductive band;

f. crimping the crimp barrel to secure an electrical contact between the conductor and the terminal through the conductive band.

5. A method of cable termination including making an electrical contact between a longitudinal cable having an axial conductor radially surrounded by insulation and a terminal having a pair of gull wing tabs with ends comprising the steps of:

a. providing a blunt cut end on the cable;

b. forming a pair of radially opposed longitudinal slits in the insulation radially inward to a depth less than that required to reach the conductor near the cut end;

c. positioning the terminal about the cut end of the cable wherein the gull wing tabs are longitudinally aligned with the slits;

d. crimping the terminal, forcing the gull wing tabs into the slits and through the remaining material between the slits and the conductor forming an electrical contact between the terminal and the conductor.

6. The method according to claim 5 further comprising the step of forming a C-design interlock between the ends of the gull wing tabs.

* * * * *